United States Patent [19]

Dydyk

[11] 4,413,243

[45] Nov. 1, 1983

[54] OPTIMIZED TRANSMISSION LINE SWITCH

[75] Inventor: Michael Dydyk, Scottsdale, Ariz.

[73] Assignee: Motorola Inc., Schaumburg, Ill.

[21] Appl. No.: 312,206

[22] Filed: Oct. 19, 1981

[51] Int. Cl.[3] ..... H01P 1/15

[52] U.S. Cl. ..... 333/258; 333/247; 333/250; 333/262

[58] Field of Search ..... 333/103, 104, 164, 247, 333/250, 258, 262

[56] References Cited

U.S. PATENT DOCUMENTS

| | | | |
|---|---|---|---|
| 3,245,014 | 4/1966 | Plutchok et al. | 333/262 |
| 3,452,305 | 6/1969 | Hefni | 333/250 X |
| 4,030,049 | 6/1977 | McQuiddy, Jr. et al. | 333/250 X |
| 4,275,367 | 6/1981 | Gaglione et al. . | |
| 4,277,764 | 7/1981 | Rosier et al. . | |
| 4,348,651 | 9/1982 | Reid | 333/262 |

*Primary Examiner*—Paul L. Gensler

*Attorney, Agent, or Firm*—Jonathan P. Meyer; Eugene A. Parsons

[57] ABSTRACT

An optimized transmission line switch comprises a first high frequency diode and means for counteracting the capacitive component of the first diode. Unpackaged diode chips are utilized to avoid parasitics introduced by diode packages. A two diode switch installed in a reduced height waveguide section provides isolation comparable to prior art switches while providing greatly improved insertion loss.

12 Claims, 10 Drawing Figures

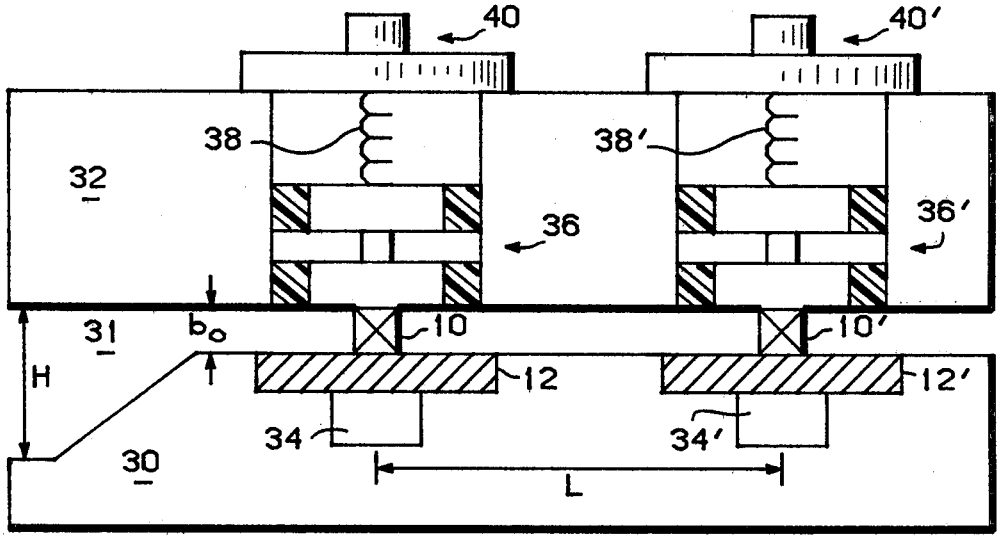
FIG 3
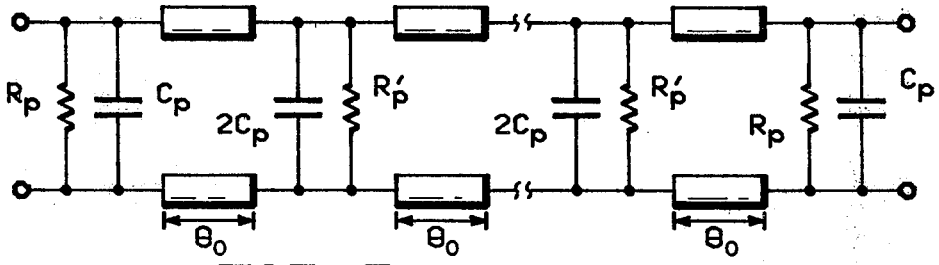
FIG 6
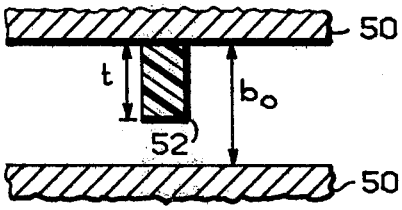
FIG 7
FIG 8
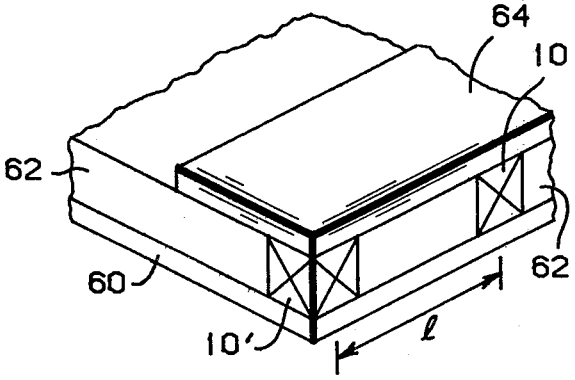

OPTIMIZED TRANSMISSION LINE SWITCH

FIELD OF THE INVENTION

The present invention relates, in general, to switches used in various transmission lines. More particularly, the invention relates to an optimized switch in which insertion loss is minimized but which retains high isolation. The switch is applicable to waveguides, microstrips and striplines, among other transmission media.

BACKGROUND OF THE INVENTION

PIN diodes are commonly used as switching elements in transmission lines operating in the microwave region and beyond. A PIN diode consists of a p-type semiconductor region separated from an n-type region by an intrinsic or i-type region. Because of their very small size they are commonly packaged to provide a more convenient size for interconnection with the transmission line. For instance, a packaged PIN diode is placed in a waveguide with one side in electrical contact with the waveguide wall and the other side connected, through a bias filter, to a source of bias voltage to operate the switch. It is customary to cascade several PIN diodes so as to obtain greater isolation, in which case the diodes are spaced one quarter of a waveguide wavelength apart, thus achieving an additional 6 db of isolation. While the isolation, which corresponds to a forward biased diode, is thus maximized, the insertion loss suffered when the diode is reverse biased is very high. The single degree of freedom availabe by adjusting the bias filter is not sufficient to optimize both states of the diode.

A portion of the capacitance which results in high insertion loss may be compensated for by very careful choice of the diode package. However, this technique depends for its repeatability on the precise geometry of the diode package and the characteristics of the individual diode, so it is not a reliable technique for production of more than a few switches.

The problems in optimizing switch performance, i.e., obtaining high isolation and low insertion loss, become substantial if transmission lines operating at millimeter wavelengths are considered. Other applications, even at lower frequencies, require isolation comparable to prior art switches and relatively low insertion loss. Moreover, the adjustment necessary to obtain best performance from prior art switches is time consuming and the remaining capacitance does not allow good performance over a wide bandwidth.

SUMMARY OF THE INVENTION

Accordingly, it is an object of the present invention to provide an improved switch for use in transmission lines.

It is a further object to provide a transmission line switch with a low insertion loss and a high isolation.

Yet another object of the present invention is to provide means for counteracting the capacitance of a reverse biased PIN diode for use in a transmission line switch.

Another object is to provide an optimized transmission line switch which requires little adjustment.

An embodiment of the present invention provides a PIN diode switch for use in a waveguide. An unpackaged PIN diode is utilized to avoid parasitic reactive components. This diode is placed in a portion of waveguide having a reduced height comparable to the height of the diode and a spring loaded bias filter supplying the control signal. The capacitive component of the diode is counteracted by another capacitance which is spaced a predetermined electrical distance from the diode. The electrical distance is chosen to optimize the cancelling effect of the two capacitive components and thus minimize the insertion loss of the circuit. The second capacitive component is preferably supplied by a second PIN diode which is interconnected to the first so as to be in the same conductive or non-conductive state. While this embodiment provides isolation comparable to prior cascaded diode pairs, it is also possible to provide a capacitive iris or dielectric tuner to supply the second capacitive component. In addition, the general method of minimizing insertion loss is applicable to other transmission media such as microstrip and stripline.

These and other objects and advantages will be apparent to one skilled in the art from the following detailed description taken together with the accompanying drawings.

BRIEF DESCRIPTION OF THE DRAWINGS

FIG. 3 is a cross section of a waveguide utilizing a PIN diode switch according to the preferred embodiment of the present invention;

FIG. 6 is an equivalent circuit for a multi-diode switch optimized according to the present invention;

FIG. 7 is a cross section of a waveguide having a dielectric tuner; and

FIG. 8 is a cross section of a microstrip circuit employing a PIN diode switch according to the present invention.

DETAILED DESCRIPTION OF THE INVENTION

Figure 1A:
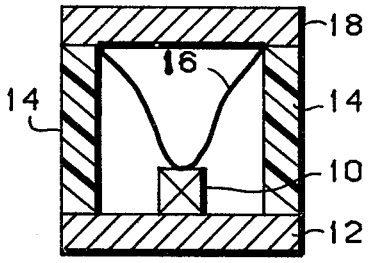
FIG. 1A is a cross section of a packaged PIN diode.
Figure 1B:
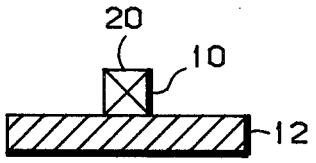
FIG. 1B is a cross section of an unpackaged PIN diode.

Referring to FIG. 1A, a PIN diode as it is conventionally packaged and utilized is shown in cross section. A PIN diode 10 is mounted on a first metallic terminal plate 12. PIN diodes are an example of a class of semiconductor junction devices which are used at microwave frequencies. The details of construction, operating characteristics and choice of a particular product are familiar in the art and are not the subject of the present invention. Diode 10 is conventionally packaged by mounting ceramic offsets 14 on first terminal plate 12. Offsets 14 allow a larger package than the small size of diode 10 would otherwise require. A wire lead 16 is bonded to diode 10 and to the tops of offsets 14. A second metallic terminal plate 18 is secured to the tops of offsets 14 and in contact with lead 16 completing the package. This packaged diode is mounted in a microwave circuit by connecting to terminal plates 12 and 18. FIG. 1B is a similar cross section of an unpackaged PIN diode having a terminal plate 12 and diode 10. This must be connected in a circuit by means of plate 12 and surface 20 of diode 10. This presents a much smaller device to which connections must be made, but avoids parasitic reactances introduced by the package.

Figure 2A:
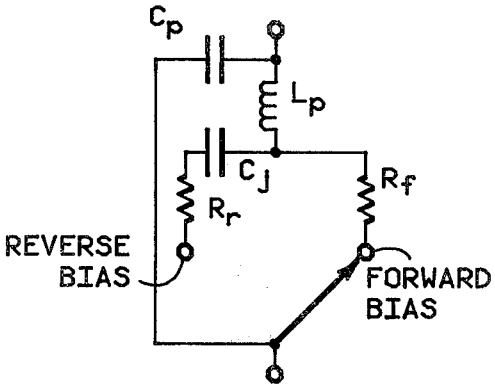
FIG. 2A is an equivalent circuit corresponding to the PIN diode of FIG . 1A.
Figure 2B:
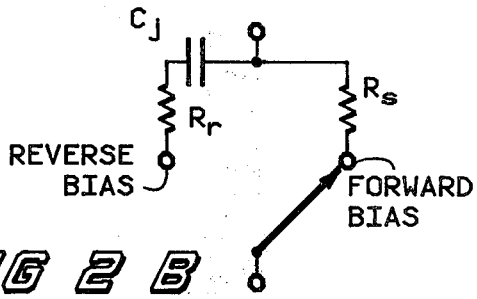
FIG. 2B is an equivalent circuit corresponding to the PIN diode of FIG. 1B.

A two state switch is primarily characterized by two parameters. Since the diode switching elements are shunt-mounted in the transmission line, as will be described below, the forward biased, or "on" switch state, corresponds to a short-circuited transmission line and the reverse biased, or "off" switch state, corresponds to an open circuited transmission line. The function of the switch in the "off" state is described by the insertion loss, which describes how much power is dissipated by the switch when it is off. The "on" state is characterized by the isolation of the switch; in other words, how well the switch blocks power flow when it is turned on. For purposes of calculation of these switch parameters, it is convenient to represent the switch by an equivalent circuit of resistances, capacitances and inductances which may be thought of as connected across the transmission line. FIG. 2A is an equivalent circuit of a packaged PIN diode used as a switch in a transmission medium such as a waveguide. The forward biased state is represented by a resistance $R_F$ in series with a parasitic inductance $L_p$, the combination being in parallel to a parasitic capacitance $C_p$. In other words, the isolation provided by this switch may be calculated as if the combination of $R_F$, $L_p$ and $C_p$ were connected across the transmission line. The reverse bias state is represented by replacing $R_F$ with a resistance $R_R$ and a capacitance $C_j$ in series. These values allow calculation of the insertion loss assocated with the switch. FIG. 2B is an equivalent circuit corresponding to an unpackaged PIN diode. The forward bias resistance $R_s$ and the reverse biased capacitance $C_j$ and resistance $R_R$ are properties of the semiconductor device, but the parasitic reactances are removed by using an unpackaged diode. Once the parasitics are removed, the primary component responsible for insertion loss is the intrinsic capacitive component $C_j$ of the diode.

As is described in detail below, the effects of $C_j$ are counteracted in the present invention by placement of a second capacitance across the transmission line at a predetermined electrical distance from the first diode.

FIG. 3 is a cross section of a waveguide having an optimized PIN diode switch according to the present invention. A lower wall 30 and an upper wall 32, together with side walls not seen here, define the waveguide, which has a characteristic height H over most of its length. A transition section 31 separates the normal height waveguide from a portion thereof with a reduced height $b_0$. As is well known, various methods may be used to provide optimum performance of such a transition section. For instance, a ramp of length substantially more than one waveguide wavelength may be used, as shown here. Reducing the height of the waveguide reduces power handling capability. For instance, a V band waveguide will require approximately a 10:1 reduction in height to accommodate a 7 mil PIN diode chip and this will reduce peak power handling capability at sea level from 32.7 kilowatts to 3.27 kilowatts. This lower power capability is not serious because it is still greater than can be readily generated at these frequencies. A first PIN diode chip 10 with terminal plate 12 is mounted in lower wall 30 of the waveguide. A heat sink 34 is used to remove heat from chip 10. A bias filter 36 extends through upper wall 32 to make contact with chip 10 and is spring loaded by spring 38 through which a control signal is conducted from connector 40. A second PIN diode chip 10' is placed a distance L along the waveguide. The arrangement of terminal plate 12', heat sink 34', bias filter 36', spring 38' and connector 40' is substantially identical to that of the first switch described above. The two diodes 10 and 10' are interconnected so that both are in the same state at the same time.

Figure 4:
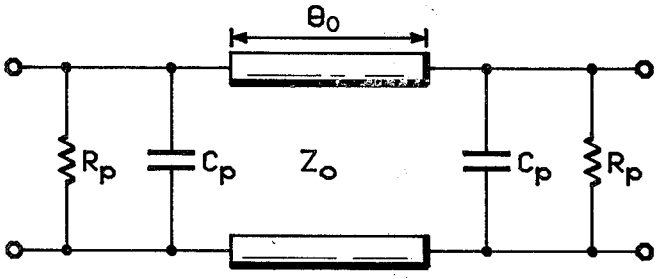
FIG. 4 is an equivalent circuit for a reverse biased PIN diode switch corresponding to the apparatus of FIG. 3.

The two diode switch of FIG. 3 may be represented in the reverse bias state by the equivalent circuit of FIG. 4. For convenience, the series circuit of $C_j$ and $R_R$ in FIG. 2B has been replaced by a parallel circuit of $C_p$ and $R_p$, where:

$$R_p = R_R\left[1 + \left(\frac{1}{\omega C_j R_R}\right)^2\right]$$

$$C_p = \frac{C_j}{1 + (\omega C_j R_R)^2}$$

So two switches, each represented by $R_p$ and $C_p$ in parallel across the transmission line, are separated by a portion of transmission line which has an impedance $Z_0$ and an electrical length $\theta$. This circuit is susceptible to conventional ABCD matrix analysis, which yields a ratio of power available, $P_a$, to power output, $P_o$, of:

$$\frac{P_a}{P_o} = W\cos^2\theta(1 - x\tan\theta)^2 + \sin^2\theta\{\sqrt{W} + X\cot\theta + \tfrac{1}{2}((\sqrt{W} - 1)^2 - x^2)\}^2$$

$$W = \left(1 + \frac{Z_o}{R_p}\right)^2$$

$$x = \omega C_p Z_o$$

The portion of the transmission line between the switches may be thought of as a means for maximizing the cancelling of the two capacitive components $C_p$. This is accomplished by taking a derivative of the above ratio with respect to $\theta$, setting this equal to 0 and solving for $\theta_0$.

$$\theta_0 = \cot^{-1}\tfrac{1}{2}\{-b \pm \sqrt{b^2 + 4}\}$$

where $$b = \frac{W(1 - x^2) + x^2 - y^2}{x(W - y)}$$

$$y = \sqrt{W} + \tfrac{1}{2}\{(\sqrt{W} - 1)^2 - x^2\}$$

Figure 5:
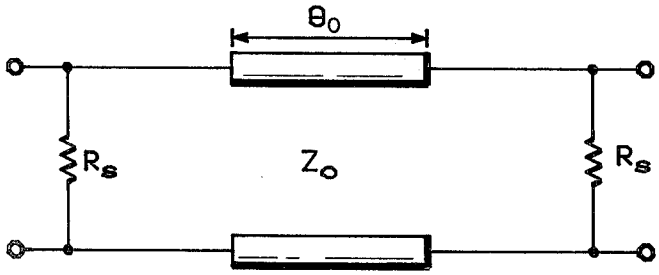
FIG. 5 is an equivalent circuit for a forward biased PIN diode switch according to the apparatus of FIG. 3.

An example of a commercially available PIN diode chip is the MA-47051 available from Microwave Associates of Burlington, Mass. The reverse bias resistance $R_R$ of this chip is 1 ohm and the capacitance $C_j$ is 0.17 pF. Assuming an operating frequency of 60 GHz and a characteristic impedance $Z_o$ of 50 ohms, the proper electrical distance $\theta_0$ for minimizing insertion loss is 30.9°, which gives an insertion loss (IL) of 1.59 dB. Once $\theta_0$ is set, the isolation is calculated according to the equivalent circuit of FIG. 5, in which two resistances $R_s$ are separated by an electrical distance $\theta_0$.

$$\text{Isolation} = 10 \log_{10} \left\{ \cos^2 \theta_0 \left( 1 + \frac{Z_o}{R_s} \right)^2 + \sin^2 \theta_0 \left( 2 + \frac{2Z_o}{R_s} + \left( \frac{Z_o}{R_s} \right)^2 \right)^2 \right\}$$

This yields an isolation of 56.52 dB for the diode chip described above. In practice, it may be that the electrical distance calculated will correspond to a physical distance which is impossible to implement due to the dimensions of the PIN diode chip. It is possible to add integral multiples of one-quarter wavelength (90°) to the spacing to avoid this problem.

A typical PIN diode switch according to the prior art uses two PIN diodes separated by 90°, or integral multiples thereof, because this provides an extra 6 dB of attenuation. While this spacing maximizes the isolation of the switch it does not optimize the insertion loss. Assuming $\theta_0$ equals 90° in the above example, the isolation would be 68.3 dB and the insertion loss would be 24.73 dB. The advantages of optimizing the operation of a transmission line switch are apparent. The present invention also provides advantages in manufacturing, however. The use of diode chips instead of packaged diodes eliminates the need to use carefully matched packages with similar parasitics. One previous method of improving switch performance involves the choice of package parasitics to match the environment. Moreover, a switch utilizing the present invention requires little adjustment. Since the performance of the switch depends primarily on the spacing and the internal capacitance $C_j$, both of which may be determined prior to installation, the switch does not require careful adjustment of the bias filter after installation. The switch according to the present invention is particularly advantageous in the millimeter wave region and in high power transmission lines.

It is also possible to extend the concept of the present invention to multi-diode switches, as shown by FIG. 6. The operation of the switch is the same, the only difference being that intermediate diodes should be chosen so that the equivalent parallel capacitance is twice that of the first and last diodes in the network. This is because each intermediate capacitance must act with two other capacitances to cancel out. Otherwise, a multi-diode application is a simple extension of the two diode case. Since the intermediate diodes have different characteristic capacitances, the resistances $R_p'$ will also be different, which will effect $\theta_0$.

Another modification of the present invention is to eliminate the second diode and replace it with a capacitive structure such as an iris or a dielectric tuner. This will fulfill the requirement for a second capacitive component to counteract the capacitance of the diode. FIG. 7 is a cross section of a dielectric tuner 52, which is preferred for its tuning versatility. Waveguide walls 50 are separated by the reduced height $b_0$. Tuner 52 is made from a material of dielectric constant $\epsilon_R$. As is familiar in the art, the height t and area A of tuner 52 are calculated to match the capacitance $C_p$ as follows:

$$t = \epsilon_R \left[ \frac{b_o - \frac{.225 \times A}{C_p}}{\epsilon_R - 1} \right]$$

The design equations for optimizing the performance of a switch using a matching capacitive structure are as follows:

$$2 \tan \theta = -b \pm \sqrt{b^2 + 4}$$

$$b = \frac{y\{1 - W^2\} - x^2 + 4W^2}{W(2x - y)}$$

$$x = 2 + \frac{Z_o}{R_p} - (\omega C_p Z_o)^2$$

$$y = \left( 2 + \frac{Z_o}{R_p} \right)^2$$

$$W = \omega C_p Z_o$$

$$IL = 10 \log_{10} \tfrac{1}{4} \left[ \{ \sqrt{y} \, (\cos \theta - W \sin \theta)\}^2 + \{x \sin \theta + 2W \cos \theta\}^2 \right]$$

$$\text{Isolation} = 10 \log_{10} \tfrac{1}{4} \left[ \{\cos \theta(1 + x) - Wx \sin \theta\}^2 + \sin^2 \theta \{1 + x + W \cot \theta\}^2 \right]$$

For the diode mentioned in the example above, the insertion loss will be 1.03 dB and the isolation is 29 dB. As is apparent to one skilled in the art, many different capacitive structures may be used to counteract the diode capacitance depending on the particular type of transmission line used.

FIG. 8 is a cross sectional view of a microstrip transmission line having a two diode switch. The transmission line is formed by ground plane 60 and microstrip line 64 which are separated by a dielectric slab 62. First and second PIN diode chips 10 and 10' have opposite faces contacting ground plane 60 and microstrip line 64, and are imbedded in dielectric 62. Second PIN diode chip 10' is separated from first PIN diode chip 10 by a distance l corresponding to an electrical distance $\theta_0$. The mathematical analysis of a microstrip transmission line having such a switch will be apparent to one skilled in the art from the description above.

While only a single pole, single throw embodiment of the present invention is discussed, it will be apparent to one skilled in the art that a combination of such switches will readily yield a single pole, double throw switch.

While the invention has been particularly shown and described with reference to a preferred embodiment thereof, it will be understood by those skilled in the art that various other modifications and changes may be made to the present invention from the principles of the invention described above without departing from the spirit and scope thereof as encompassed in the accompanying claims.

I claim:

1. In a transmission line an optimized switch, comprising:

a first switchable element in the transmission line, said first switchable element introducing a predetermined first capacitance across the transmission line while said first switchable element is in a first state;

capacitive means in the transmission line for counteracting said first capacitance; and at least one portion of the transmission line interposed between said first switchable element and said capacitive means along a propagation direction of said transmission line, said at least one portion having a predetermined impedance and an electric length not equal to an integral multiple of 90°, said predetermined impedance of said at least one portion being identical to an impedance of at least a local region of the transmission line.

2. The switch according to claim 1 wherein said electrical length is chosen so as to substantially minimize an insertion loss of the switch.

3. The switch according to claim 1 wherein said capacitive means comprises:

a dielectric tuner.

4. The switch according to claim 1 wherein said capacitive means comprises:

a second switchable element substantially identical to said first switchable element, said first and second switchable elements being interconnected so as to be in the same state.

5. The switch according to claim 1 wherein said capacitive means comprises:

a plurality of switchable elements disposed along the transmission line at intervals of said electrical length, intermediate elements of said plurality of switchable elements having a capacitance substantially twice said first capacitance, said first switchable element and said plurality of switchable elements being interconnected so as to be in the same state.

6. The switch according to claim 1 wherein said first switchable element comprises:

an unpackaged PIN diode.

7. The switch according to claim 6 wherein said transmission line comprises:

a waveguide having a reduced height portion substantially equal to a height of said unpackaged PIN diode.

8. An apparatus, comprising:

a waveguide having a reduced height over a portion of a length thereof;

a first unpackaged high frequency diode mounted in said reduced height portion of said waveguide, said diode having a height substantially equal to said reduced height of said waveguide; and capacitive means in said reduced height portion of said waveguide for counteracting a capacitive component of said first diode, said capacitive means being separated from said first diode by at least one length of said waveguide along a propagation direction of said waveguide, said at least one length having a predetermined impedance and an electrical length not equal to an integral multiple of 90°.

9. The switch according to claim 8 wherein said electrical length is chosen so as to substantially minimize an insertion loss of the switch.

10. The apparatus according to claim 9 wherein said capacitive means comprises:

a dielectric tuner disposed in said waveguide.

11. The apparatus according to claim 9 wherein said capacitive means comprises:

a second unpackaged high frequency diode substantially identical to said first diode.

12. The apparatus according to claim 9 wherein said capacitive means comprises:

a plurality of high frequency diodes disposed along said waveguide at intervals of said electrical length, intermediate diodes of said plurality of diodes having a capacitive component substantially twice said capacitive component of said first diode.

* * * * *